US005364095A

United States Patent [19]

Easton et al.

[11] Patent Number: 5,364,095

[45] Date of Patent: Nov. 15, 1994

[54] TUBULAR METAL BALL BAT INTERNALLY REINFORCED WITH FIBER COMPOSITE

[75] Inventors: James L. Easton, Los Angeles; Gary W. Filice, Moorpark; Roger Souders, Poway; Charles Teixeira, Littlerock, all of Calif.

[73] Assignee: Easton Aluminum, Inc., Van Nuys, Calif.

[21] Appl. No.: 704,678

[22] Filed: May 21, 1991

Related U.S. Application Data

[63] Continuation of Ser. No. 320,594, Mar. 8, 1989, abandoned.

[51] Int. Cl.[5] ..... A63B 69/36

[52] U.S. Cl. ..... 273/72 A

[58] Field of Search ..... 156/86, 293, 294, 165, 156/287; 428/34.9, 35.8, 36.1; 273/67 A, 72 R, 72 A, 80 R, 80 B, DIG. 7, DIG. 13

[56] References Cited

U.S. PATENT DOCUMENTS

| | | | |
|---|---|---|---|
| 3,697,069 | 10/1972 | Merda | 273/72 A |
| 3,876,204 | 4/1975 | Moore et al. | 273/72 A |
| 4,023,801 | 5/1977 | Van Auken | 273/80 B |
| 4,047,731 | 9/1977 | Van Auken | 428/35.8 |
| 4,082,277 | 4/0478 | Van Auken et al. | 273/DIG. 7 |
| 4,348,247 | 9/1982 | Loyd et al. | 156/294 |
| 4,505,479 | 3/1985 | Souders | 273/72 A |

FOREIGN PATENT DOCUMENTS

| | | | |
|---|---|---|---|
| 1230776 | 5/1971 | United Kingdom | 156/294 |
| 2053696 | 2/1981 | United Kingdom | 273/DIG. 23 |
| 2059596 | 4/1981 | United Kingdom . | |

*Primary Examiner*—Mark S. Graham

*Attorney, Agent, or Firm*—Roth & Goldman

[57] ABSTRACT

A hollow metal tube and method making same are disclosed in which the tube includes a reinforcing sleeve compressively engaged with the interior of the tube. The sleeve is formed of carbon fibers in an epoxy matrix. The method of making the tube results in the wall of the tube being compressed against the sleeve, which imparts a high rate of wall recovery if the tube is impacted. Accordingly, the article is particularly useful as a ball bat or other tubular structure which may be subjected to external forces or impact.

8 Claims, 1 Drawing Sheet

TUBULAR METAL BALL BAT INTERNALLY REINFORCED WITH FIBER COMPOSITE

CROSS REFERENCE TO RELATED APPLICATIONS

This is a continuation of application Ser. No. 07/320,594 filed Mar. 8, 1989, now abandoned, from which priority is claimed under 35 USC 120.

BACKGROUND OF THE INVENTION AND PRIOR ART

This invention relates to reinforced metal tubes, and will be described with particular reference to a hollow aluminum ball bat having a carbon composite core. The articles and methods disclosed are not however limited to ball bats and have widespread application wherever high strength, lightweight tubes are required and, more particularly, where the tubular structure is comprised of a protective metal overlayer and a fiber composite underlayer for added strength.

Examples where such structures are particularly useful include many sports applications in addition to ball bats such as bicycle frames and seat posts, shafts for golf clubs, sailboat and windsurfing masts and booms, and hockey sticks. A particularly useful application of such tubes is the seat post for off road or all terrain bicycles where a long post enables one to have a smaller frame which gives a better ride.

Over the years, a great number of hollow metal baseball bat designs have been disclosed. See, for example, U.S. Pat. No. 4,248,425, Easton, issued Feb. 3, 1981. Some of these designs include inserts which are intended to dampen vibration and increase the impact resistance of the bat when striking a ball. Examples of these types of designs are disclosed in U.S. Pat. No. 3,861,682, issued to H. Fujii on Jun. 15, 1976, and U.S. Pat. No. 4,323,239 issued to J. Ishii on Apr. 6, 1982.

Various composite tubular elements in which a metal tube is provided with an exterior wrapping of carbon reinforcing fibers are disclosed in U.S. Pat. Nos. 4,173,670 issued Nov. 6, 1979; 4,131,701 issued Dec. 26, 1978; 4,084,819 issued Apr. 18, 1978; 4,082,277 issued Apr. 4, 1978; and 4,023,801 issued May 17, 1977; all to Richard L Van Auken.

Some attempts have also been made to coat or wrap the exterior of a metal bat with materials intended to enhance batting performance. An example of this type of design is disclosed in U.S. Pat. No. 4,025,377, issued to Y. Tanikawa on May 24, 1977.

In general, exterior wrappings and coatings on tubular metal articles do not provide a significant improvement in articles subject to external impacts or other forces such as metal ball bats or bicycle parts. This is particularly true for bicycle seat tubes which are clamped inside of a frame tube because carbon fibers on the exterior of the seat tube will become damaged and lose structural integrity if the frame tube is clamped directly on these fibers.

Accordingly, it is an object of the present invention to provide a new and improved strong and lightweight structure comprised of a metal tube having internal carbon fiber reinforcing.

It is another object of the present invention to provide a new metal ball bat having a very high rate of wall recovery during impact.

SUMMARY OF THE INVENTION

The present invention accordingly provides an internally reinforced metal tube structure having at least one layer of carbon fibers on the interior thereof. A preferred embodiment of the invention is a metal ball bat having an elongated hollow metal tubular body, a portion of which is designated as a ball striking, or impacting area, the interior of which is reinforced with carbon fibers.

The ball striking area may further be provided with a reduction in the thickness of the wall of the hollow metal body. This reduction may be accomplished by forming a recess in the inside wall of the body, or the wall could be butted to provide a thinned portion for selective interior carbon reinforcement.

A reinforcing member in the form of a hollow sleeve fits within the tube, and the outside dimensions of the sleeve and the inside dimensions the tube are such that compressive forces are generated between the inside wall of the tube and the outer wall of the sleeve. This compression fit locks the sleeve in the tube and provides the ball striking area of the bat with a high rate of wall recovery during impact.

Other objects, features and advantages will become apparent from a reading of the specification in conjunction with the drawings where like reference numerals designate or refer to like elements in the several views.

DESCRIPTION OF THE PREFERRED EMBODIMENT

Although the invention will be described with particular reference to a metal ball bat, it will be appreciated by those skilled in the art that the teachings herein are applicable to other articles as well.

Figure 1:
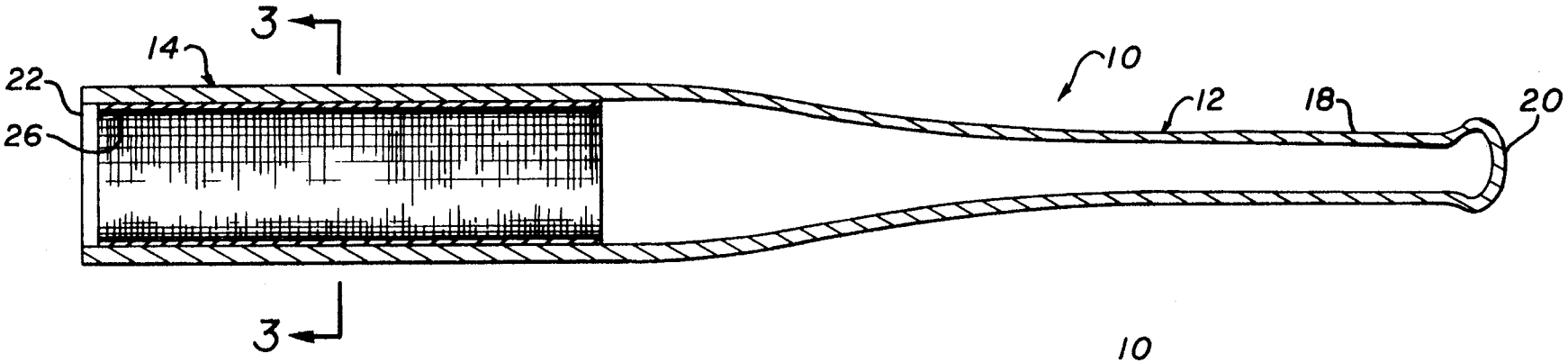
FIG. 1 is a cross section of a hollow metal tubular body of a metal bat constructed in accordance with the teachings of the invention.

Referring to FIG. 1, there is shown in cross section a hollow metal tube 12 used to construct a bat 10 in accordance with the teaching of the invention. The tube 12 includes a generally cylindrical barrel portion 14, a tapered portion 16 and a handle portion 18 terminating in a knob 20.

Figure 2:
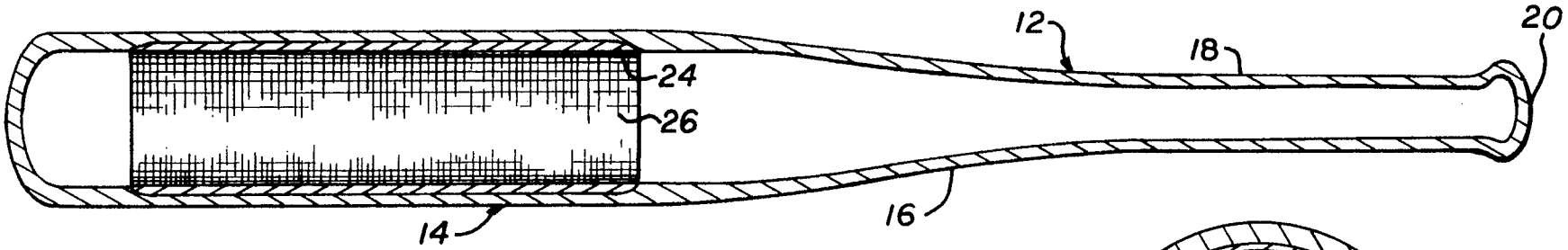
FIG. 2 is a cross sectional view of a metal bat body similar to the body of FIG. 1 but having a rolled over end and provided with an internal recess having a reinforcing sleeve installed therein.
Figure 3:
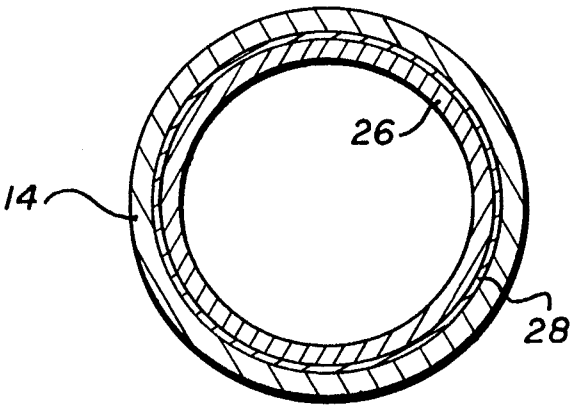
FIG. 3 is a cross sectional view of FIG. 1, taken along the line 3—3, and showing the placement of the reinforcing sleeve relative to the interior of the body of the metal bat.

The barrel 14 is preferably provided with a recess 24 formed in the interior wall of the tube 12, as shown in FIG. 2. The recess 24 is the result of a reduction in the thickness of the wall of the tube 12 in an area of the barrel portion 14, which area is designated the ball striking portion of the bat 10.

By way of example, the tube 12 may be constructed of aluminum alloy tubing, using alloys such as types CU31, 7046 and 7178. The desired shape of the tube 12 is achieved by successively drawing the aluminum alloy tubing until the desired interior wall profile and thickness are achieved, along with the desired outside diameter. The method of drawing a tube to produce a barrel recess in known as butting.

The wall thickness of the tube 12 in the area of the recess 24 is typically between 40% to 60% of the thickness of the unrecessed wall of the tube 12 in the areas on either end of the recess 24. Thus, for example, the recessed wall thickness may typically range from 0.05 inches in a bat having an unrecessed wall thickness of 0.08 inches, to a recessed wall thickness of 0.08 inches in a bat having an unrecessed wall thickness of 0.12 inches.

A composite sleeve 26 is provided which is formed by winding a sheet of carbon fiber and matrix materials onto an expandable mandrel. In the preferred embodiment of a ball bat, the fibers are carbon fibers oriented in a bi-directional 90° woven configuration. Other orientations of the carbon fibers may be desired for other types of articles depending upon the end use to which the article is to be put. The fibers are supported in a matrix material which includes a thermally setting resin such as epoxy, which remains soft and pliable until heat cured. The fiber matrix combination forms a pliable sheet. Persons skilled in the art will appreciate that a thermoplastic resin could be used in place of a thermally setting resin.

The sleeve 26 is formed as follows. The sheet material described above is sized in width so that the resultant sleeve 26 will fit within the recess 24. The sized sheet is wound around an inflatable mandrel which includes an expandable bladder, well known in the art. Alternatively an expandable solid mandrel of elastomeric material such as silicone having a draw bolt longitudinally extending therethrough may be used. The number of wraps of the sheet around the mandrel may be varied from one wrap to a plurality of wraps, depending on the desired characteristics of the completed bat 10. Typically, three wraps are employed.

The diameter of the unexpanded mandrel is such that the wound sheet, forming the sleeve 26, may be inserted into the tube 12 through the end 22. When the sleeve 26 is adjacent the recess 24, the mandrel is expanded using bladder air pressure of about 80 pounds per square inch or, if a solid mandrel is used, the draw bolt is pulled to axially compress and radially expand the solid mandrel. The expanded mandrel causes the sleeve 26 to also expand and to press against the interior wall of the recess 24. To ensure bonding of the sleeve 26 the barrel 14, a film adhesive 28, such a type FM 73, manufactured by American Cyanamid, or a fiberglass insulator may be applied to the interior wall of the recess 24 prior to insertion of the sleeve 26. The preferred orientation of the carbon fibers, relative to the axis of the bat, is 0° for half of the weave fibers, and 90° for the other half of the weave fibers.

The entire assembly of the tube 12 and expanded sleeve 26 is then subjected to a thermal cure by raising its temperature to about 250° Fahrenheit for about 45 minutes. The air pressure is maintained in the bladder or suitable tension is maintained on the draw bolt during the curing cycle.

During the thermal cure, the elevated temperature causes the aluminum tube 12 to expand slightly, which allows the sleeve 26 to also expand. After the curing cycle, as the assembly cools, the tube contracts but the sleeve, which is now cured, does not contract to any substantial degree since the coefficient of thermal expansion of the aluminum tube is substantially larger than the coefficient of thermal expansion of the carbon fibers of the sleeve. Accordingly, the cooling tube contracts down over the cured sleeve 26, generating considerable compressive forces in the order of several thousand pounds per square inch. The carbon composite sleeve handles these forces without buckling, thus resulting in a pre-load stress on the sleeve.

After the assembly has cooled, the bladder is deflated or the tension in the draw bolt is relaxed so that the expansible mandrel may be removed from the tube 12.

The above described construction of the bat 10 enables the use of a very thin aluminum wall in the ball striking portion of the bat, resulting in a lighter weight and lower inertia than in the prior art metal bats. One example of a bat constructed in accordance with the teachings of the invention has a "blank weight" of minus 13 oz. A negative or minus blank weight results when the weight of the bat in ounces is subtracted from the length of the bat in inches. Typical prior art bats of, e.g. a 34 inch length ordinarily weigh about 34 ounces and therefore do not have a significant negative blank weight. A negative blank weight permits the bat to be swung faster with the same amount of energy input than a heavier bat with the result of a substantially larger impact to the ball upon contact therewith.

The contraction of the barrel 14 described above results in a locking action of the sleeve 26 in the recess 24. Further, the placement of the composite sleeve 26 inside the aluminum barrel 14 protects the composite from the shattering forces generated by direct impact of the ball. The resultant bat 10 exhibits high durability without breakdown of the composite sleeve. In turn, the sleeve imparts a high rate of wall recovery to the bat during impact. This is due to the low inertia and high stiffness of the wall which result from the higher modulus of elasticity of the carbon fiber matrix.

While particular reference has been made to using this invention in conjunction with bats having recesses, persons skilled in the art will readily appreciate that recesses are not a necessary requirement to working the invention.

This invention is also particularly well suited to the manufacture of seat posts for bicycles. Bicycles with smaller frames, such as all terrain bicycles require longer seat posts than conventional bicycles to keep the rider at the correct elevation. Unlike ball bats which are subject to radial impact forces, the primary consideration in the manufacture of bicycle seat posts is light weight and flexural strength in the longitudinal direction. Accordingly, for applications of this type, orientation of the carbon fibers at a 0° orientation relative to the axis of the tube, i.e., longitudinally of the tube, is desired. A 7075 T9 aluminum alloy tube having a typical outside diameter of 0.990 to 1.080 inches and a wall thickness of 0.025 to 0.045 inches has been provided with a 0.030 to 0.050 inch thick carbon fiber reinforcement comprising a single layer of fibers oriented at 0° relative to the axis of the tube by use of the methods described above. By way of comparison, typical prior art seat posts of the same outside diameter for off road bicycles are constructed entirely of 5XXX and 6XXX alloys which weigh approximately 0.470 ounces per inch of length and have a yield strength in bending of 40,000 psi. The resulting thin wall aluminum reinforced seat post of the present invention weighs 0.210 ounces per inch and has a yield strength in bending of 90,000 psi and is thus lighter, stronger and stiffer than prior art posts of all metal construction.

This invention is further well suited to the manufacture of shafts for golf clubs. Unlike ball bats or bicycle seat posts, shafts for golf clubs must have adequate resistance to twisting—i.e., torsional resistance. Accordingly, for applications of this type, orientation of the carbon fibers at a selected angle of orientation such as ±45° relative to the axis of the shaft may be employed.

While the invention is disclosed in detail with respect to the described embodiments, it is not intended that the invention be limited solely thereto. Many other applications of these structures will occur to those skilled in the art which are within the spirit and scope of the invention, and it is thus intended that the invention be limited in scope only by the appended claims.

We claim:

1. In a ball bat having an impacting portion for contacting a ball to be batted, the improvement wherein said impacting portion is comprised of an elongated metal tube, said metal tube having an inside wall, and a hollow sleeve of reinforcing fibers oriented in a bidirectional pattern in a resin matrix, said sleeve being compressively restrained inside said metal tube by compressive forces in the order of several thousand pounds per square inch between said inside wall of said metal tube and the outer wall of said sleeve.

2. The ball bat of claim 1, in which said sleeve is woven and said reinforcing fibers comprise carbon.

3. The ball bat of claim 2, in which said reinforcing fibers are oriented at 0° and at 90° with respect to the axis of said metal tube.

4. The ball bat of claim 3, wherein said metal tube has a wall portion of reduced thickness comprising a recess and said sleeve fits within said recess.

5. The ball bat of claim 4, wherein said wall portion of reduced thickness has a thickness of from 0.05" to 0.08".

6. The ball bat of claim 4, wherein said metal tube is aluminum.

7. The ball bat of claim 6, wherein said reinforcing fibers are graphite.

8. The ball bat of claim 7, further comprising a layer of adhesive interposed between said inside wall of said metal tube and said outer wall of said hollow sleeve.

* * * * *